US005602636A

United States Patent [19]

Matsuzawa

[11] Patent Number: 5,602,636

[45] Date of Patent: Feb. 11, 1997

[54] IMAGE FORMING APPARATUS

[75] Inventor: Kunihiko Matsuzawa, Kawasaki, Japan

[73] Assignee: Canon Kabushiki Kaisha, Tokyo, Japan

[21] Appl. No.: 407,684

[22] Filed: Mar. 21, 1995

[30] Foreign Application Priority Data

Mar. 24, 1994 [JP] Japan ..... 6-076370

[51] Int. Cl.[6] ..... G03G 21/00

[52] U.S. Cl. ..... 399/388

[58] Field of Search ..... 355/317, 308, 355/309

[56] References Cited

U.S. PATENT DOCUMENTS 5,136,342 8/1992 Ida et al. ..... 355/317

*Primary Examiner*—Nestor R. Ramirez
*Attorney, Agent, or Firm*—Fitzpatrick, Cella, Harper & Scinto

[57] ABSTRACT

An image forming apparatus has a photosensitive member for carrying an image, an exposure device for exposing the photosensitive member to form a latent image on the same, a development device for developing the latent image on the photosensitive member with a toner to form a toner image, a transfer member carrier for supporting and conveying a transfer member to a transfer position on the phtosensitive member, a first conveyance mechanism for conveying the transfer member to the transfer carrier member, and a second conveyance mechanism for conveying the transfer member to the first conveyance mechanism. A cancellation mechanism is provided to cancel a transfer member conveying force of the first conveyance mechanism after a leading end of the transfer member conveyed by the first conveyance mechanism has been supported on the transfer member carrier. A trailing end of the transfer member passes through a nip of the second conveyance mechanism during a period of time when the transfer member conveying force of the first conveyance mechanism is canceled by the cancellation mechanism and when the exposure device is not operating. In this arrangement, vibration generated when the transfer member is conveyed to the transfer member carrier by the first and second conveyance mechanisms is prevented from affecting the latent image formation made by the exposure device.

26 Claims, 13 Drawing Sheets

IMAGE FORMING APPARATUS

BACKGROUND OF THE INVENTION

1. Field of the Invention

The present invention relates to an image forming apparatus such as a printer, a facsimile machine or a copying machine and, more particularly, to a multiple image forming apparatus in which an image is formed on a transfer member carried by a transfer member carrier.

2. Description of the Related Art

Conventionally, image forming apparatuses have been used in which a toner image formed on a photosensitive drum is transferred to a transfer member carried and transported by a transfer drum to complete image formation. FIG. 14 shows an example of such conventional image forming apparatuses.

The process of the recording operation of the image forming apparatus shown in FIG. 14 will be described in detail. When the apparatus starts operating, one of recording paper sheets is fed from a paper feeder unit and is conveyed to register rollers 102 by pre-conveyance rollers. At this time, the register rollers 102 are stopped. The conveyance operation of the pre-conveyance rollers is continued for a short time after the moment at which the leading end of the recording paper sheet is brought into abutment against the register rollers 102. When the recording paper sheet forms a predetermined loop (hereinafter referred to as "pre-register loop"), the pre-conveyance rollers are stopped.

Thereafter, the register rollers 102 and the pre-conveyance rollers are rotated in synchronization with an image recording start signal to feed the recording paper sheet onto a transfer drum 101. This operation is performed to enable an image to be formed at a predetermined position on the recording paper sheet.

On the other hand, a latent image is formed on a photosensitive drum 100 by performing image exposure with laser light E on the basis of an image signal. This latent image is developed with a toner.

The recording paper sheet is conveyed to an image transfer position T while being supported on the transfer drum 101, and the toner image on the photosensitive drum 100 is recorded by being transferred onto the surface of the recording paper sheet. The recording paper sheet is supported on the transfer drum 101 by one of several possible methods, i.e., an electrostatic attraction method, an air suction method and the like.

If in the thus-arranged apparatus a difference occurs between the speeds of the photosensitive drum 100 and the transfer drum 101, a deterioration is caused in the quality of the resulting image, that is, the transferred image is expanded or contracted or is blurred by rubbing. Ordinarily, to avoid this problem, the two drums are driven by the same drive source and, more preferably, the two drums are linked and the driving force is directly transmitted to them so that the speed difference therebetween is minimized.

If there is a difference between the recording paper conveying speed of the register rollers 102 and the peripheral speed of the transfer drum 101, a problem described below arises. If the recording paper conveying speed of the register rollers 102 is lower than the peripheral speed of the transfer drum 101, the recording paper sheet pulls the transfer drum 101 to change the speed of this drum after being supported thereon. It is also possible that, in the worst case, the recording paper sheet peels off the transfer drum 101.

Conversely, if the recording paper conveying speed of the register rollers 102 is higher than the peripheral speed of the transfer drum 101, the recording paper sheet starts forming a loop between the register roller 102 and the transfer drum 101 to cause and increase a force of pressing the transfer drum 101. When this force exceeds a certain magnitude, the speed of the transfer drum 101 is changed. This change causes a change in the speed of the photosensitive drum 100 linked to the transfer drum 101, resulting in expansion or contraction of the latent image formed during sheet conveyance.

To cope with this problem, a method has generally been practiced in which the recording paper conveying speed of the register rollers 102 is set slightly higher than the peripheral speed of the transfer drum 101 at the stage of designing so that there is no possibility of the recording paper conveying speed of the register roller 102 being lower than the peripheral speed of the transfer drum 101 with respect to any dispersion in certain part accuracy ranges. This is because only a small relative reduction in the recording paper conveying speed of the register rollers results in a considerable deterioration in image quality while a relative increase in the recording paper conveying speed in certain allowance is negligible.

A mechanism for setting the recording paper sheet free by separating a pair of register rollers 102 from each other has also been provided. This is intended to separate the register rollers 102 before a loop of the recording paper sheet between the register rollers 102 and the transfer drum 101 (hereinafter referred to as "post-register loop") formed by earlier registration pushes the transfer drum 101 (this separating operation hereinafter referred to as "register release") in order to increase the looping space so that the force of the recording paper sheet in the looping state is reduced.

However, the recording paper conveying speeds of the pre-register rollers and the register roller 102 are ordinarily set to the same speed because the pre-register rollers and the register rollers 102 simultaneously convey the same sheet for a certain period of time. Accordingly, the recording paper conveying speed of the pre-conveyance rollers is slightly higher than the peripheral speed of the transfer drum 101 and, therefore, a loop is also formed and increased between the pre-conveyance rollers and the transfer drum 101. This loop ceases to exist instantaneously when the trailing end of the recording paper sheet passes the pre-conveyance rollers. Then, the force acting on the transfer drum 101 changes abruptly to cause a change in the speed of the transfer drum 101. The shock of such a change may also be transmitted to the photosensitive drum 100 to affect the latent image during the formation on the photosensitive drum 100.

By considering this problem, a method may be used in which the pre-register or post-register looping space is maximized so that the curvature of the loop is reduced if the amount of loop is constant. However, it is difficult to provide such a large looping space and to limit the increase in the overall size of the apparatus. On the other hand, there is a limitation upon simply reducing the amount of loop since a certain effect of use of the loop must be achieved.

Recently, apparatuses having more complicated sheet feeder units have generally been developed. Such apparatuses require an elongated and complicated sheet path from the feeder unit to the register rollers. Under such circumstances, variation in sheet conveyance speed tends to increase and a certain amount of loop is indispensable also for absorbing variation in sheet conveyance speed.

A mechanism for removing the recording paper conveying speed may be provided for the pre-register rollers as well as for the register rollers to prevent occurrence of vibration when the trailing end of the recording paper sheet passes the pre-register rollers, as disclosed in EP 0 480 454 A2. Use of such a mechanism, however, necessitates an increase in manufacturing cost and is also disadvantageous in terms of space factor.

SUMMARY OF THE INVENTION

In view of these problems, an object of the present invention is to provide an image forming apparatus capable of performing image formation always suitably without being affected by vibration generated when a transfer member is conveyed to a transfer member carrier.

Another object of the present invention is to provide an image forming apparatus in which transmission of vibration of a sensitive member is prevented during latent image formation to ensure good performance of latent image formation.

Still another object of the present invention is to achieve the above objects without providing any special mechanism for transfer member conveyance means.

These and other objects and features of the present invention will become apparent from the following detailed description of the invention made with reference to the accompanying drawings.

DESCRIPTION OF THE PREFERRED EMBODIMENTS

An image forming apparatus in accordance with the present invention will be described in detail with reference to the accompanying drawings.

Embodiment 1

The image forming apparatus in accordance with first embodiment of the present invention will be described with reference to FIGS. 1 through 9. The image forming apparatus described below has an electrophotographic type image forming system and is arranged as a multicolor image forming apparatus which is assumed to be one in which the present invention can be realized most effectively.

Figure 1:
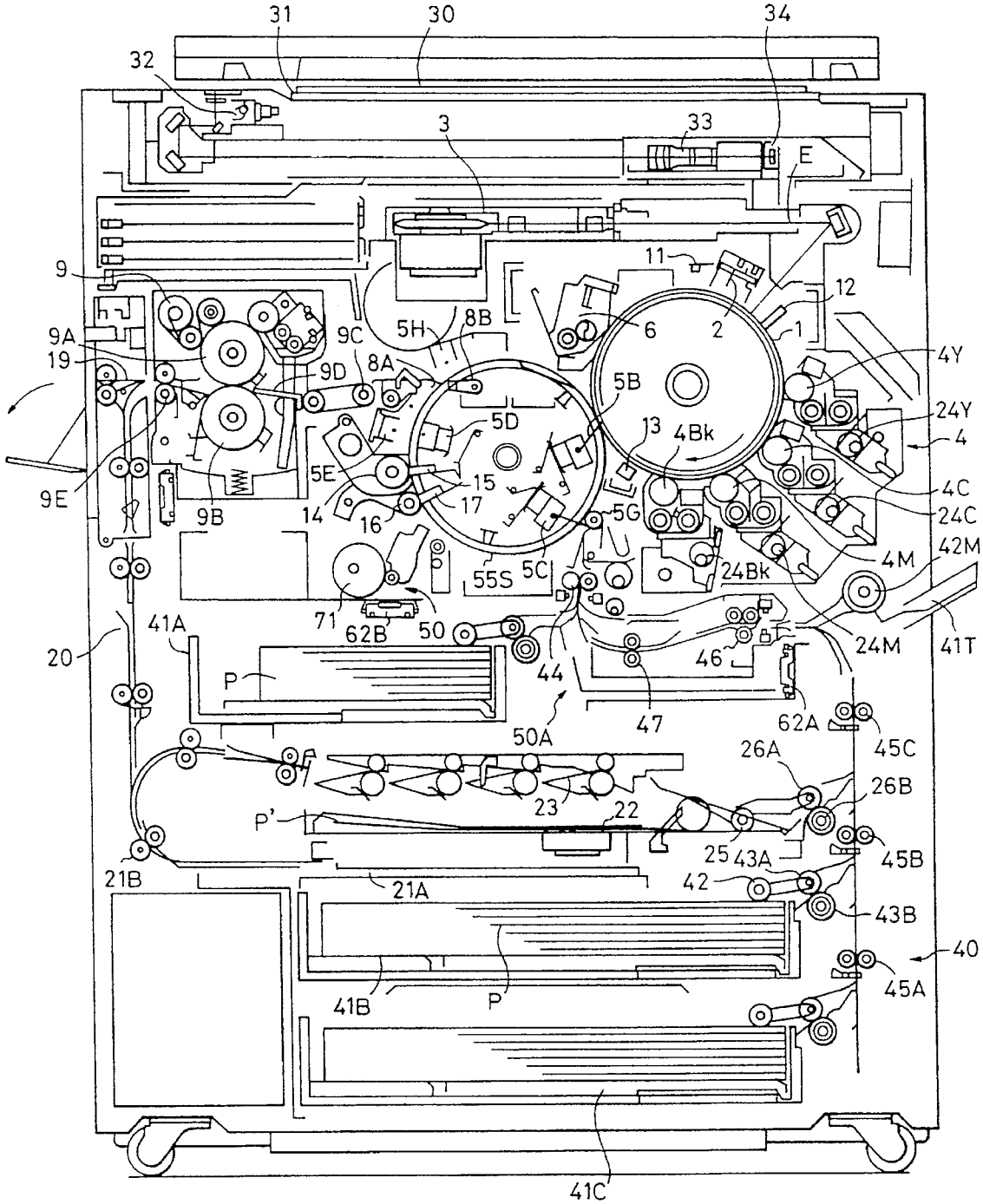
FIG. 1 is a cross-sectional view of a multicolor image forming apparatus in accordance with a first embodiment of the present invention.

The color image forming apparatus shown in FIG. 1 has an upper section constructed as a digital color image reader and a lower section constructed as a printer.

In the reader section, the operation is started by an image recording start signal to expose and scan an original 30 on an original table glass 31 with an exposure lamp 32. Reflected image light from the original 30 is condensed to a full-color sensor 34 by a lens 33 to obtain a color decomposed image signal. This signal is amplified by an amplifier (not shown), undergoes various processing in a video processing unit (not shown), and is sent to the printer section.

The printer section is constructed as described below. A photosensitive drum provided as an image carrier is axially supported at its center and is driven by a motor (not shown) to rotate in the direction of the arrow. An exposure optical system 3 formed of a pre-exposure lamp 11, a primary charging device 2, a laser device and other components, a potential sensor 12, a development device 4, an on-drum light quantity detection means 13, a transfer drum 5 and a cleaning device 4 are arranged in this order along the direction of rotation of the photosensitive drum 1 so as to face the outer circumferential surface of the photosensitive drum 1.

The surface of the photosensitive drum 1 is uniformly charged by the exposure lamp 11 and the primary charging device 2. Thereafter, the surface of the photosensitive drum 1 is exposed to light E, e.g., a laser beam, which is modulated with a recording image signal and scanned by a polygon mirror 3A, a lens 3B and other components of the optical system 3, thereby forming an electrostatic latent image on the photosensitive drum surface. The electrostatic latent image is developed by the development device 4. In the development device 4, four units 4Y, 4C, 4M, and 4Bk containing developers, i.e., toners for four colors, yellow, cyan, magenta and black, respectively, are arranged. The development device 4 is constructed so that each of these units can be selectively brought close to the photosensitive drum 1 by the operation of eccentric cams 24Y, 24C, 24M, and 24Bk.

The image formed by these toners is transferred to a recording paper sheet in a recording region. Residual toner on the photosensitive drum 1 after transfer to the recording paper sheet is scraped off by the cleaning device 6 on the downstream side of the image transfer region. Image formation with toners is performed by the above-described process.

This image forming apparatus has three feeder cassettes, i.e., upper, middle and lower feeder cassettes 41A, 41B, and 41C, and one manual insertion cassette 41T. The three feeder cassettes 41A, 41B, and 41C have the same construction. In the following, only the middle feeder cassette 41B will be described as a representative example.

A sheet feeder unit 40 is formed of the middle feeder cassette 41B, a pickup roller 42 for feeding recording paper sheets P one by one out of the cassette 41B, and means for conveying each recording paper sheet P fed out by the pickup roller 42 to a transfer and conveyance unit 50, i.e., feed rollers 43A and 43B, conveyance rollers 45A, 45B, and 45C, sheet guides and other components. The manual insertion unit is formed of the manual insertion tray 41T, a feed roller 42M, a separating pad (not shown) and other components.

The transfer and conveyance unit 50 has a conveyance section 50A and the transfer drum 5 as two essential portions. The conveyance section 50A will first be described with reference to FIG. 2. The conveyance section 50A has guides 48A, 48B, 48C, 48D, and 48E, conveyance rollers 46A, 46B, and 46C, and a pair of pre-register conveyance rollers 47 for guiding recording paper sheet P from the sheet feeder unit 40, and register means having a pair of register rollers 44 for feeding recording paper sheet P to the transfer drum 5 in accordance with the timing of image formation in an image forming section, and attraction guides 48F and 48G for guiding recording paper sheet P in association with the register rollers 44.

The conveyance rollers 46A, 46B, and 46C have a curling function for enabling the recording paper sheet to be easily wrapped around the transfer drum 5. Each of the guides 48B and 48D has a rounded shape such as to change the direction in which the recording paper sheet advances and is supported so as to be swingable in the direction of the arrow indicated in FIG. 2 (these guides hereinafter referred to as swingable guides) in order to provide a sufficient space for looping of recording paper sheet P caused when the leading end of the recording paper sheet is temporarily stopped by the register rollers 44.

Figure 3:
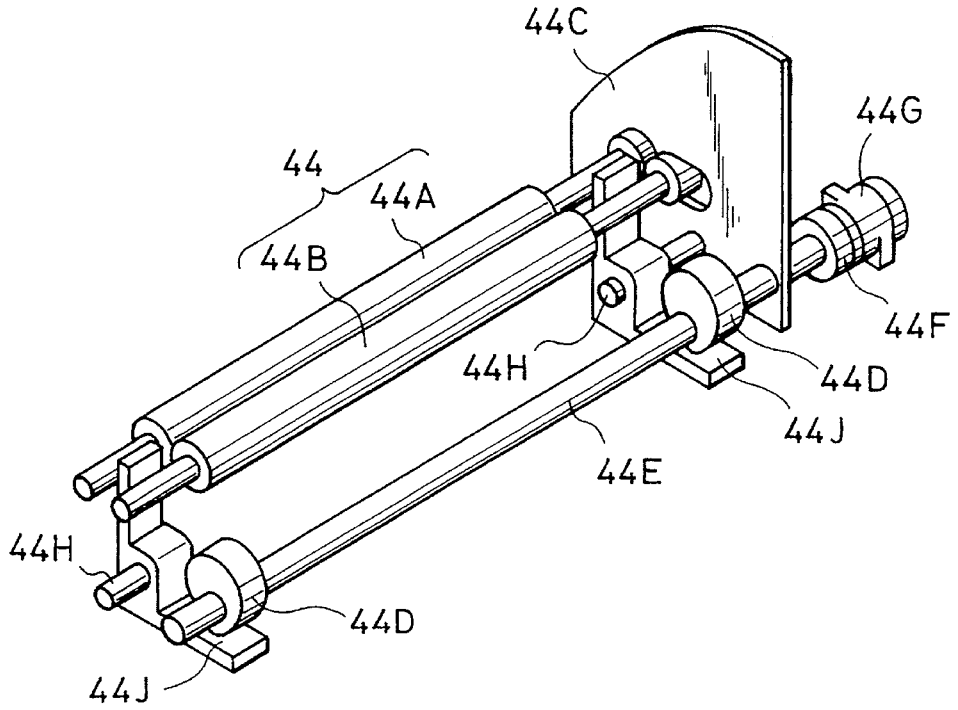
FIG. 3 is a perspective view of a pressure-contact state of register rollers.
Figure 4:
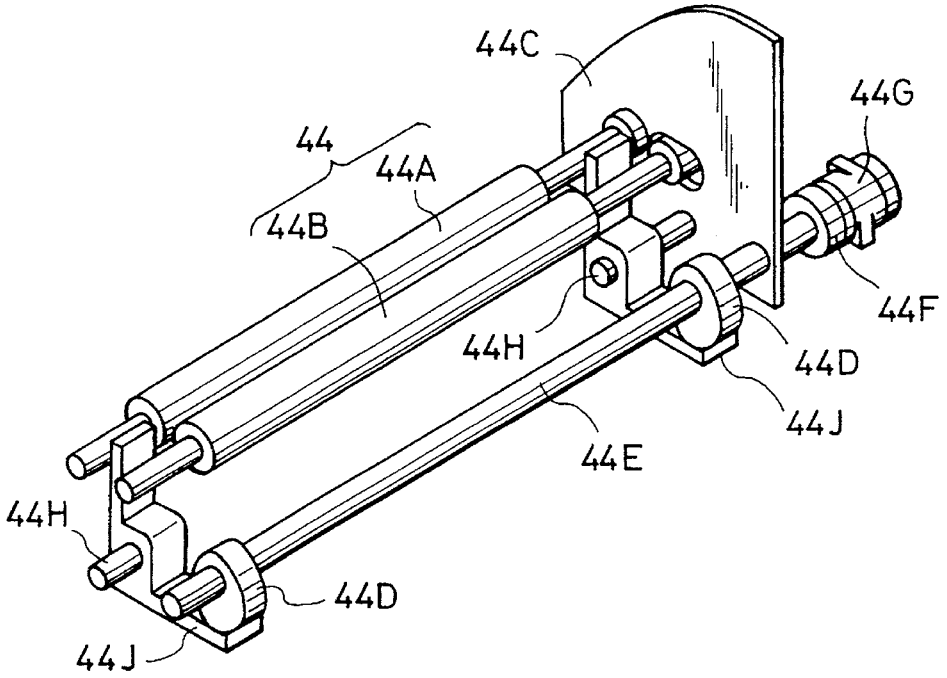
FIG. 4 is a perspective of a separated state of the register rollers shown in FIG. 3.

The construction of a mechanism including the register rollers 44 will be described with reference to FIGS. 3 and 4. Referring to FIG. 3, the pair of register rollers 44 consist of a metallic roller 44A and a rubber roller 44B disposed parallel to each other, and these two rollers are pressed against each other by springs (not shown). The rubber roller 44B is supported at its opposite ends by bearings in elongated holes formed in side plates 44C (the side plate 44C and the bearing on the foreground side not illustrated in FIG. 2) so as to be separable from the metallic roller 44A. A cam shaft 44E is supported on the side plates 44C parallel to the metallic roller 44A and the rubber roller 44B, and two release cams 44D are fixed on the cam shaft 44E at a certain distance from each other. A gear 44F and a spring clutch 44G for transmitting a driving torque from a unit body to the cam shaft 44E are fixed on one end of the cam shaft 44E. Swingable arms 44J are provided in correspondence with the release cams 44D. One end of each swingable arm 44J contacts the corresponding one of the release cams 44D while the other end is inserted into the spacing between end portions of the metallic rollers 44A and the rubber roller 44B.

In the thus-constructed mechanism, the gear 44F and the spring clutch 44G (and an unillustrated plunger) are operated in association with each other to selectively rotate each of the release cam 44D and to stop the same after rotation through 180°. During rotation, each release cam 44D presses the end of the corresponding swingable arm 44J to cause the swingable arm 44J to swing on an arm center shaft 44H. With this swinging motion of the swingable arm 44J, the other end of the swingable arm 44J is brought into contact with the rubber roller 44B to displace the same against the force of the press-contact spring. The rubber roller 44B is thereby moved apart from the metallic roller 44A. That is, the position at which the two rollers 44A and 44B are pressed against each other and the position at which the two rollers 44A and 44B are moved apart from each other are set in accordance with the phase of the stoppage of the release cams 44D. This mechanism enables the register rollers 44 to effect register release by a timing described later. It is not always necessary to effect register release by separating the rollers 44A and 44B, and register release may be effected by reducing the pressure of contact between the rollers 44A and 44B to zero while the rollers 44A and 44B are maintained in contact with each other.

Figure 5:
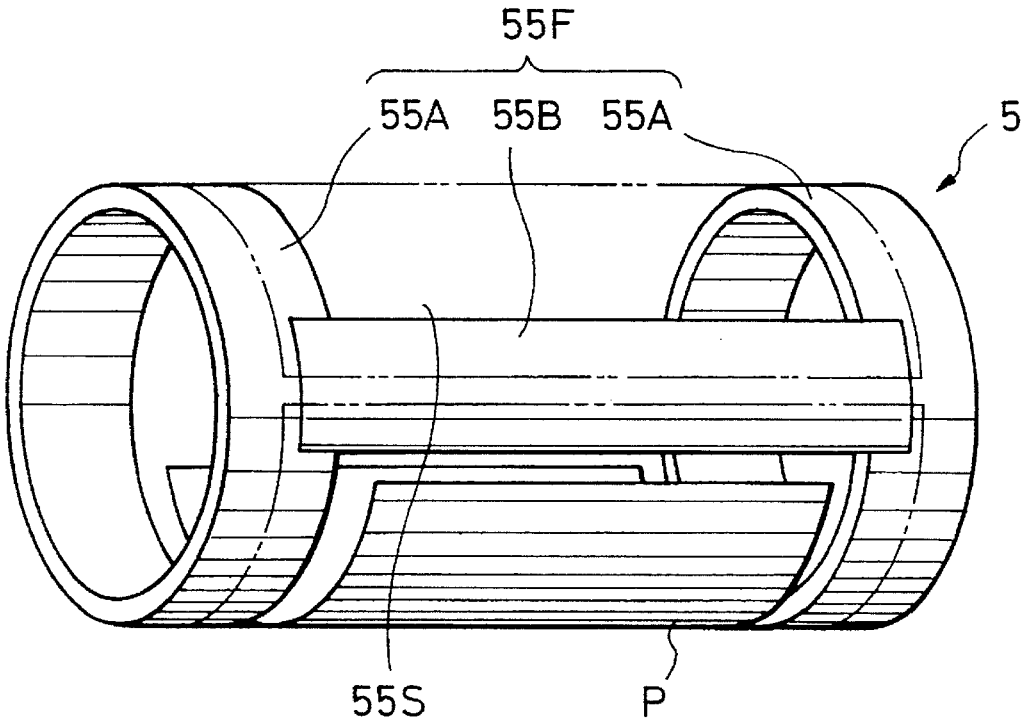
FIG. 5 is a perspective view of a transfer drum.

The transfer drum 5 will next be described with reference to FIG. 5. As illustrated, the transfer drum 5 has a frame 55 formed of two annular members 55A and a connecting member 55B which connects these annular members 55A. A recording paper supporting sheet 55S is cylindrically wrapped around the frame 55F. The recording paper supporting sheet 55S is made of, for example, polyethylene telephthalate (PET) or polyvinylidene fluoride (PVF).

Referring again to FIG. 2, an attraction roller 5G is supported so as to be able to contact and move apart from the transfer drum 5 at a position where recording paper sheet P fed from the register rollers 44 is brought into abutment against the transfer drum 5. Also, an attraction charging device 5C including a backup member for resisting a pressing force of the attraction roller 5G is disposed on the side of the recording paper supporting sheet 55S opposite from the attraction roller 5G.

As also shown in FIG. 1, a transfer charging device 5B is also disposed on the reverse side of the recording paper supporting sheet 55S in an image region where the photosensitive drum 1 and the transfer drum 5 are face each other. On the downstream side of the transfer charging device 5B, separating members for separating the recording paper sheet, more specifically a charge-removing charging device 5H, a separating claw 8A and a sheet push-up roller are disposed. Subsequently, charging devices 5D and 5E for removing charge from the recording paper supporting sheet are disposed with the recording paper supporting sheet interposed therebetween. Further, on the downstream side of these charging devices are disposed a brush roller 14 and a corona discharging device or a brush type charge removing device 15 for cleaning the recording paper supporting surface of the supporting sheet by removing toner, paper particle and the like attached to the recording paper supporting surface. It is possible that oil used in a fixation unit 9 is attached to the recording paper supporting sheet surface through the recording paper sheet during later-mentioned both side recording. An oil removing roller 16 and a backup brush for cleaning the recording paper supporting sheet by removing attached oil are also provided.

The transfer drum 5 can be brought into contact with or moved apart from the photosensitive drum 1. When the ordinary operation of the apparatus is not performed, the transfer drum 5 is maintained apart from the photosensitive drum 1 in order to prevent the transfer drum 5 and the photosensitive drum 1 from contacting each other for a long time as well as to prevent damage to the surface of the photosensitive drum 1 caused by contact with the recording sheet or any other matter during jam removal operation. The transfer drum S and the photosensitive drum 1 have gear flanges at their corresponding ends, which mesh with each other to transmit a torque of the photosensitive drum 1 to the transfer drum 5 when these drums contact each other.

Further, in this apparatus, the transfer and conveyance unit 50 is constructed so as to be forwardly drawable out of the main body in order to perform jam removal or maintenance operation reliably and easily.

The fixation unit 9 has a fixation roller 9A having an internal heat source such as a halogen heater, a pressing roller 9B which is pressed against the fixation roller 9A (which may also has a heat source), a conveying belt 9C and an entrance guide 9D for leading the recording paper sheet to the nip between the rollers 9A and 9B, and a sheet discharge roller 9E for leading the recording paper sheet discharged from the rollers 9A and 9B to the outside of the apparatus.

A mechanism for automatically recording images on the two surfaces of the recording paper sheet will now be described. A conveyance path changeover guide 19 is disposed immediately downstream of the fixation unit 9. After fixation, one of a recording sheet path for discharging the recording paper sheet out of the apparatus body and another recording sheet path for both side recording is automatically selected by the conveyance path changeover guide 19. The both side recording sheet path is formed by a vertical conveyance path 20, an inverting path 21A, an inverting roller 21B, and an intermediate tray 22. The recording paper sheet having an image recording on its one surface is led to temporarily enter the inverting path 21A and is conveyed out of the inverting path 21A in the direction opposite to the entering direction by the reverse rotation of the inverting roller 21B to be received by the intermediate tray 22 with its trailing end at the time of introduction reversely set as leading end. Thereafter, the recording paper sheet is fed again out of the intermediate tray 22 and an image is formed on the other surface of the recording paper sheet by the above-described image forming process. A plurality of guides 23 are arranged above the intermediate tray 22 so as to be selectively movable downwardly or upwardly according to the recording paper size, thereby enabling recording paper sheets of any size to be accommodated and stacked in the intermediate tray 22 with the sheet ends aligned with a head position of the intermediate tray 22.

A control unit (not shown) is provided with a control circuit board and a motor drive circuit board for controlling the operation of the above-described mechanism in each unit.

The operation of the image forming apparatus constructed as described above will be described with respect to a case where paper sheets are fed from the intermediate cassette 41B.

Referring to FIG. 1, when the image formation start signal is generated, a cam 71 rotates through 180°. By this cam rotation, the transfer drum 5 moves swingingly to an operating position at which the gears on the flanges of the transfer drum 5 and the photosensitive drum 1 mesh with each other, and the transfer drum 5 rotates in synchronization with the photosensitive drum 1. On the other hand, recording paper sheets P in the intermediate cassette 41B are fed out one by one by the pickup roller 42. Each recording paper sheet P from the cassette 41B is conveyed between the feed guides to the conveyance section 50A by the feed rollers 43A and 43B and conveyance rollers 45B and 45C.

Figure 2:
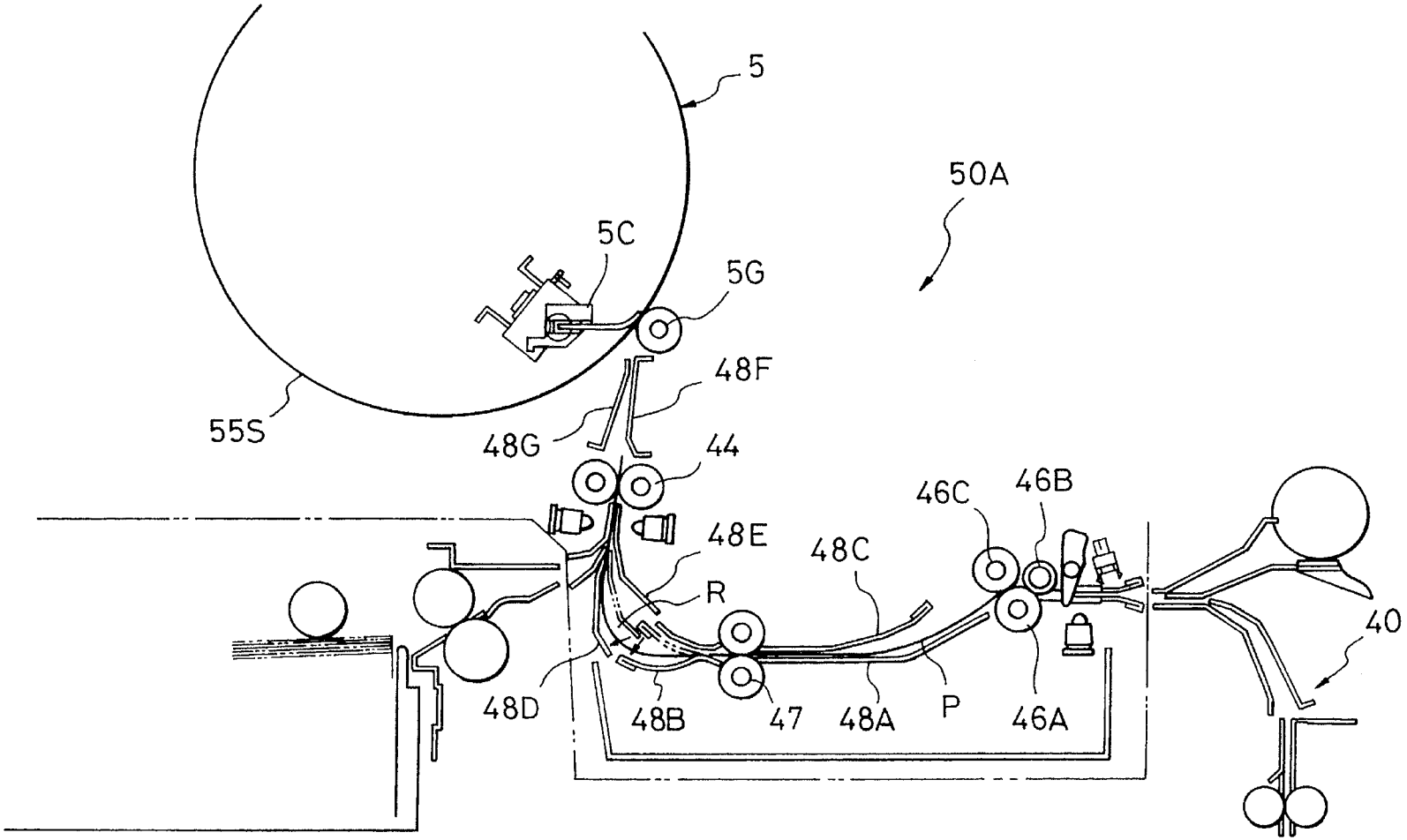
FIG. 2 is a diagram of details of a recording sheet feed passage in the apparatus shown in FIG. 1.

In the conveyance section 50A, as shown in FIG. 2, the recording paper sheet P curls by a predetermined amount in a direction such as to be wrapped around the transfer drum 5 when it passes the conveyance rollers 46A, 46B, and 46C which serve as curling rollers. Thereafter, the recording paper sheet P is conveyed to the register rollers 44 while the direction of conveyance is changed by the functions of the pre-register conveyance rollers 47. During this conveyance, the register rollers 44 are stopped and the leading end of the recording paper sheet is brought into abutment against the nip between the register rollers 44.

The pre-register conveyance rollers 47 are driven for a certain period of time after the abutment, and are then stopped. A pre-register loop of the recording paper sheet is thereby formed. The space necessary for forming this loop is provided by the swinging motion of the swingable guides 48B and 48D in the feed guides 48A to 48E. This swinging motion is automatically made in such a manner that an intermediate portion of the recording paper sheet presses and outwardly displaces the guides as indicated at R in FIG. 2.

In this embodiment, the amount of pre-register loop is set to 8 mm. This value represents the amount of feeding further made after the leading end of the recording paper sheet has been brought into abutment against the register rollers 44. This feeding is required to ensure desired stability of feeding from the lower cassette 41C (FIG. 1) in which a largest variation may be exhibited in the time taken for the recording paper sheet to reach the register section.

Thereafter, at a certain time determined on the basis of the time at which image forming section starts image formation, the register rollers 44 and the pre-register conveyance rollers 47 start rotating. This rotating timing is set so that the recording paper sheet and the toner image on the photosensitive drum 1 coincide with each other at the image transfer region.

When the recording paper sheet P is brought into abutment against the transfer drum 5, it is electrostatically attracted onto the recording paper supporting sheet 55S by corona discharge from the attraction charging device 5C and by the operation of the attraction roller 5G. The attraction roller 5G is normally set apart from the transfer drum 5 to reduce the load upon the transfer drum 5, and is pressed against the transfer drum only when the recording paper reaches the transfer drum 5. The transfer drum 5 is rotated in synchronization with the photosensitive drum 1, and the recording paper sheet is conveyed to the image transfer region while being supported on the transfer drum 5. The toner image formed on the photosensitive drum 1 by the above-described process is transferred onto the surface of the transfer drum 5 by the transfer charging device 5B, and the recording paper sheet is thereafter conveyed to the separation section.

The image in one color is thus transferred. Then, if the image to be completed is a monochromic image, the recording sheet is separated by the operation described below. If a multicolor image is to be formed, the separating operation is not performed and the recording sheet is again conveyed to the transfer region by making one revolution while being supported on the transfer drum. The next toner image is then transferred by being superposed on the preceding toner image. These steps are repeated a necessary number of times. The brush roller 14, etc., for cleaning, which are supported so as to be able to contact and move apart from the transfer drum 5 surface, are set apart from the transfer drum 5 surface at least during the above-described multi-transfer process.

As illustrated in FIG. 1, when the above-described process is completed, the attraction force between the recording paper sheet and the recording paper supporting sheet 55S is reduced by the operation of the charge-removing charging device 5H in the separation section, and the recording paper sheet P is thereafter separated from the transfer drum 5 by the operation of the separating claw 8A, etc.

The recording paper sheet separated from the transfer drum 5 is conveyed to the fixation roller section by the conveying belt 9C and is accurately guided along the entrance guide 9D to the nip between the rollers. The toner images are fixed on the paper surface by the heat from the fixation roller 9A. Thereafter, the recording paper sheet is conveyed by the discharge roller 9E to be discharged out of the apparatus. Finally, the transfer drum 5 is moved apart from the photosensitive drum 1 to a receding position and the operation of the apparatus is stopped.

The operation of the image forming apparatus for both side recording will next be described. Referring to FIG. 1, when the changeover guide 19 is operated, recording paper sheet P having a recorded image fixed on one of its two surfaces is led to the vertical conveyance path 20, and is thereafter conveyed in the opposite direction through the inverting path 21A by the inverting roller 21B to be accommodated in the intermediate tray 22. After a necessary number of one-side-recorded recording paper sheets P' have been stacked in the intermediate tray 22, one-side-recorded sheets P' are fed out of the intermediate tray 22 one by one by the pickup roller 25, and each recording sheet P' is conveyed to the conveyance section 50A by the feed rollers 26A, 26B, etc. The same process as that described above is thereafter performed to record an image on the other surface of the recording paper sheet. Finally, the discharge operation is performed without operating the changeover guide to discharge the recording sheet having recorded images fixed on its two surfaces out of the apparatus.

Figure 6A:
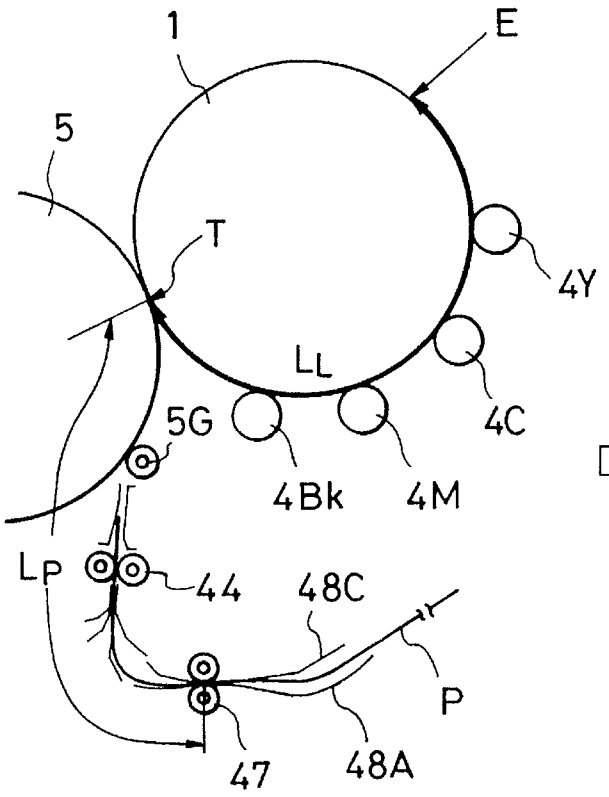
FIGS. 6(A), 6(B), and 6(C) are diagrams of a process in which a recording sheet is conveyed from pre-register conveyance rollers and is supported on the transfer drum.
Figure 6B:
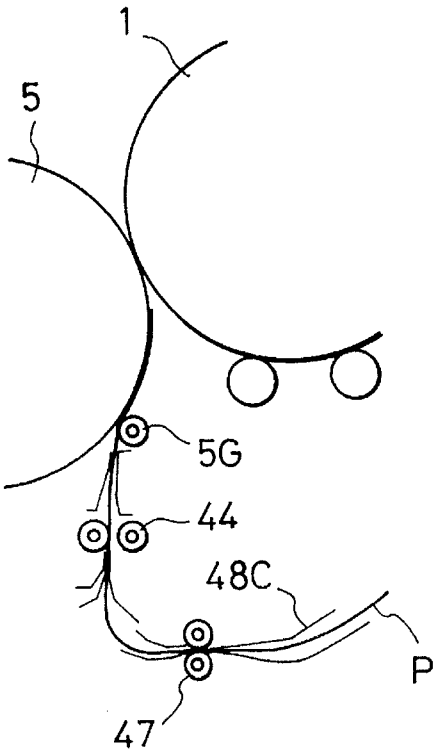
Figure 6C:
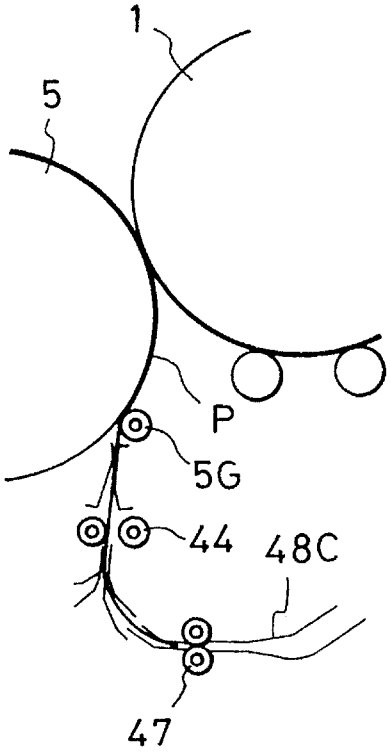

The operation from the step of conveying each recording paper sheet from the pre-register conveyance rollers 47 to the step of transferring the image onto the recording paper sheet will be described in further detail with reference to FIGS. 6(A) to 6(C), which show three stages of this process; FIG. 6(A) shows a state immediately after the time when the register rollers 44 starts rotating after the formation of the pre-register loop, FIG. 6(B) shows a state immediately after the time when the register rollers 44 are released after the attraction of the recording paper sheet to the transfer drum 5, and FIG. 6(C) shows a state immediately after the time when the recording paper sheet passes the pre-register conveyance rollers 47. In the state (C), the loop has disappeared.

Referring to FIGS. 6(A), 6(B), if the distance between a latent image formation position E to an image transfer position T along the circumferential surface of the photosensitive drum 1 is $L_L$, and if the paper path length from the nip between the pre-register conveyance rollers 47 and the image transfer position T along the recording paper sheet is $L_P$, then $L_L>L_P$. If the distance between latent images in the case of successively making latent image formation by inputting another image formation start signal (this distance substantially equal to the interval between fed recording paper sheets in the case of successively making image formation on a plurality of recording paper sheets) is $L_S$, then $L_P>(L_L-L_S)$ is established.

Figure 7:
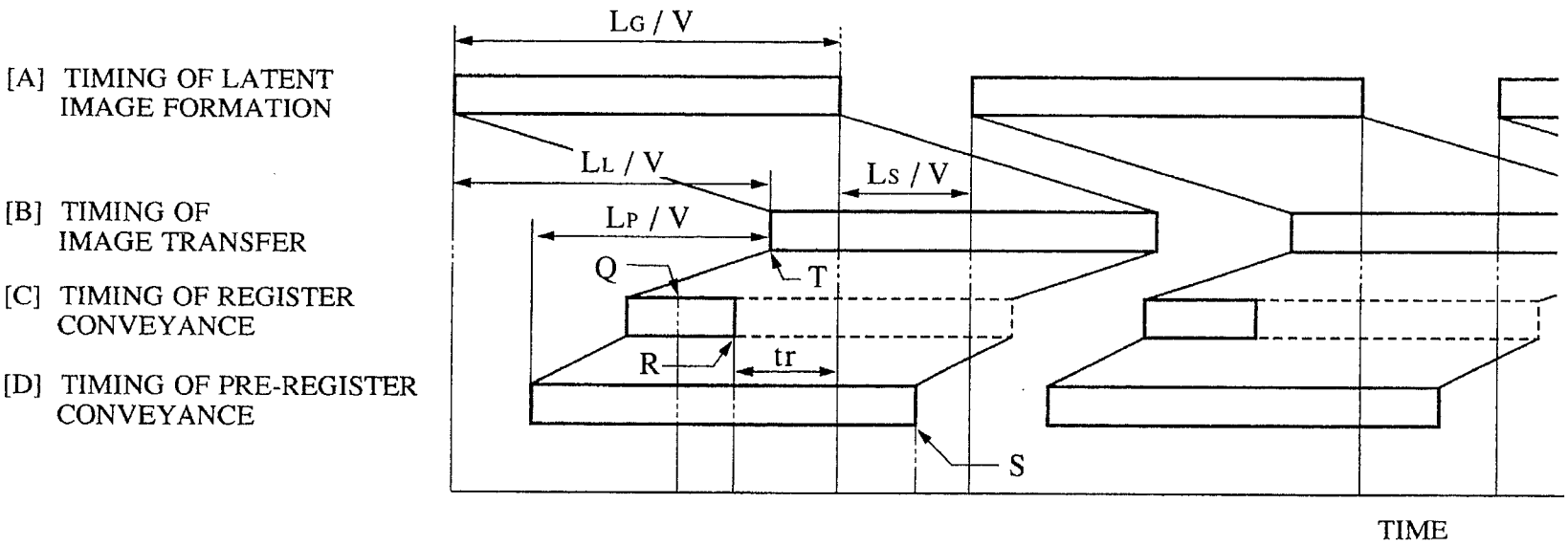
FIG. 7 is a timing chart of an image forming process of the first embodiment.

The operation in such a case will further be described with reference to the timing chart of FIG. 7. First, the surface of the photosensitive drum 1 is exposed to laser light to continue latent image formation for a time period $L_G/V$ [A]. V represents the sensitive drum speed of the transfer drum speed.

On the other hand, the leading end of the recording paper sheet is brought into abutment against the nip between the pre-register conveyance rollers 47 with a small delay from the start of latent image formation, about $(L_L-L_P)/V$, and the conveying rotation is continued for a time period corresponding to the recording sheet length. Actually, the rotation is stopped for a short time after the formation of the pre-register loop during this period. However, this stop time is very short and negligible in the timing chart [D].

The recording paper sheet reaches the register rollers 44 with a further delay from the moment at which the leading end of the recording paper sheet is brought into abutment against the pre-register conveyance rollers 47. After the formation of the pre-register loop, the operation of driving the register rollers 44 is started. At a time when the recording sheet leading end advances several ten millimeters after the moment at which it passing the attraction roller 5G (point Q) , register release is effected (point R) and the rotation is simultaneously stopped [C]

Thereafter, the image and the recording sheet coincide with each other at the transfer position T (point T), and image transfer is effected [B].

The operation of this apparatus will now be described with respect to a feature of the present invention with reference to changes with time in the force of the recording paper sheet acting on the transfer drum 5 shown in FIG. 8. A value F1 in FIG. 8 represents a lower limit of the influence upon image formation of the force acting on the transfer drum 5.

Figure 8:
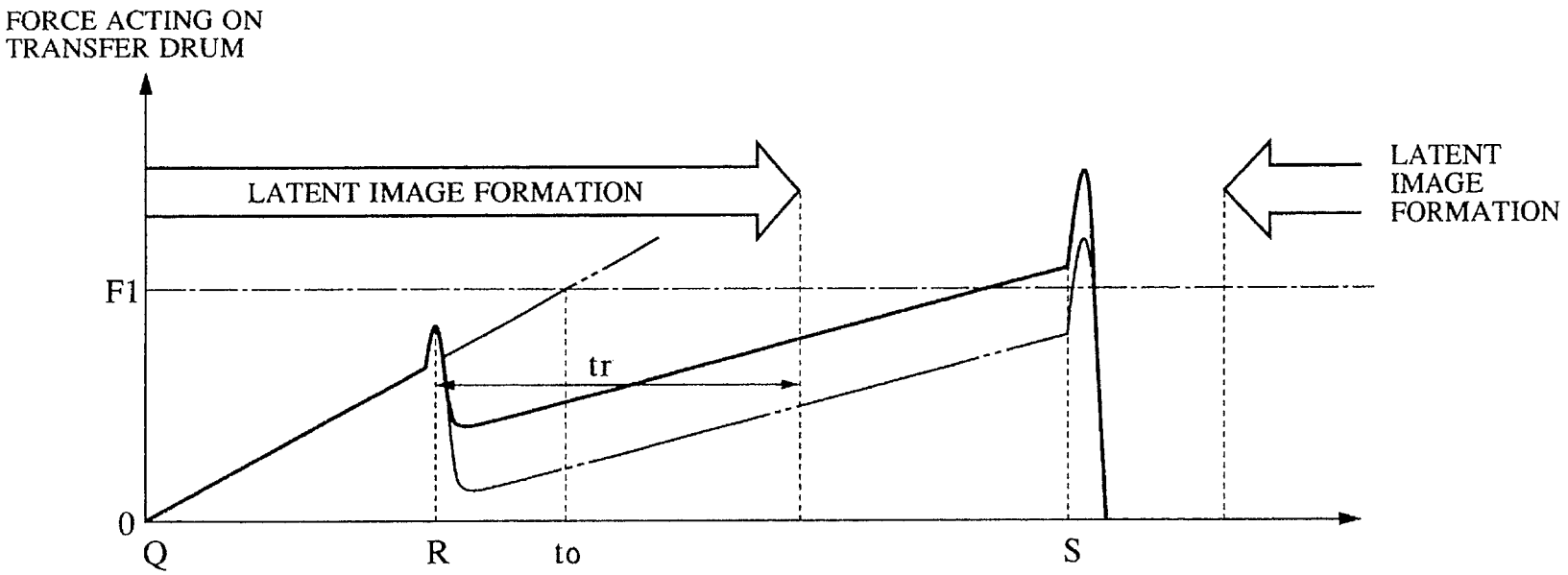
FIG. 8 is a graph showing changes with time of the force of the recording sheet acting on the transfer drum in the image forming process.

As shown in FIG. 8, latent image formation is not made at the moment when the trailing end of the recording paper sheet passes the nip between the pre-register conveyance rollers 47 (point S). That is, even if the magnitude of the shock thereby caused exceeds F1, there is no influence upon the latent image formation. During the period of time between the recording paper sheet attraction to the transfer drum 5 (point Q) and the register release (point R), the loop is increased between the register rollers 44 and the transfer drum 5 so that the force acting on the transfer drum 5 is gradually increased. However, register release has been effected at the time $T_O$ when F1 is exceeded (point R), and there is, therefore, substantially no influence upon the image.

After the register release (point R), the loop between the pre-register conveyance rollers 47 and the transfer drum 5 is gradually increased. With respect to this state, a method will suffice in which an optimal loop space is maintained or the sheet conveying speed of the rollers is selected so that the loop does not cause a force exceeding F1 in a time period $t_r$ through which latent image formation is continued after register release. It is not difficult to achieve such an effect. For example, it is possible to use a method described below. In this embodiment, the pre-register conveyance rollers 47 are temporarily stopped after the formation of the pre-register loop, and the register rollers 44 and the pre-register conveyance rollers 47 are thereafter driven simultaneously. The pre-register loop is not reduced by such driving. In contrast, if the rotation of the pre-register conveyance rollers 47 is started a certain time period after the moment at which the rotation of the register rollers 44 is stopped, then the pre-register loop is reduced by an amount corresponding to the time period through which the pre-register conveyance rollers 47 are stopped, so that the force of the recording paper sheet acting on the transfer drum 5 after register release can be reduced, as indicated by the double-dot-dash line in FIG. 8. There is no problem in terms of sheet conveyance performance since the pre-register loop is necessary only before the register rollers 44 start rotating.

The image forming apparatus arranged as described above have advantages described below. At a moment when the trailing end of the recording paper sheet passes the nip between the pre-register conveyance rollers 47 in the register released state, a certain shock is transmitted to the transfer drum 5 and the photosensitive drum contacting the transfer drum 5. This shock, however, does not affect the image formation since latent image formation is not made at that moment.

In this embodiment, a latent image can be prevented from being disturbed while no special mechanism for the pre-register conveyance rollers 47 is provided. It is also possible to reduce the force of the recording paper sheet acting on the transfer drum 5 and to reduce the necessary loop space by differentiating the time at which driving of the register rollers 44 is started and the time at which driving of the pre-register conveyance rollers 47 is started.

Specific examples of the path lengths of the components of this embodiment will be described. In the type of apparatus having a plurality of development devices fixed in combination around the photosensitive drum as described above, the latent image formation position on the photosensitive drum is naturally set in a certain range if the various mechanisms necessary for image formation are arranged so that the overall size of the apparatus is reduced. For example, in this embodiment, the exposure-transfer path length $L_L$=320 mm. Also, the recording sheet interval is determined by the specifications of the apparatus, and its value is $L_S$=110 mm. Then, it is necessary that the path length $L_P$ between the pre-register conveyance rollers 47 and the transfer position T satisfies $320>L_P>210$ mm. In this embodiment, however, $L_P$=250 mm.

For limitation of the overall size of the apparatus, it is preferred that the point Q at which the recording paper sheet is attracted to the transfer drum 1 surface is brought close to the transfer position T. However, a certain path length is required to stabilize the effect of attracting the paper sheet. It has been experimentally found that the path length between the attraction position and the transfer position T has an optimal value of 90 mm. Accordingly, the paper path length between the pre-register conveyance rollers 47 and the attraction position is 160 mm.

The selection of an optimal position of the register rollers 44 when the paper path length between the pre-register conveyance rollers 47 and the attraction positions is 160 mm as mentioned above will be described below.

In determining the position of the register rollers 44, it is important to minimize the influence of the pre-register and post-register loops upon the transfer drum 5. It is necessary to set the amount of pre-register loop to 5 to 8 mm because of the need to correct biasing of the recording paper sheet as mentioned above. Conversely, the post-register loop is gradually formed due to a small difference between the speeds of the register rollers 44 and the transfer drum 5, and its amount is smaller than 1 mm at the maximum.

By considering these conditions, it can be said that enlargement of the space for the pre-register loop is more effective in reducing the influence upon the transfer drum 5. Generally, for enlargement of the pre-register loop, it is preferred that path length between the register roller 44 position and the attraction position is smaller than that between the register roller 44 position and the pre-register conveyance rollers 47, although the suitable the register roller 44 position varies to some extent depending upon the guide configuration. In this embodiment, the ratio of the path length between the pre-register conveyance rollers 47 and the register rollers 44 and the path length between the register rollers 44 and the attraction position is determined as 3:2, that is, the former length is set to 96 mm while the latter length is set to 64 mm.

Figure 9:
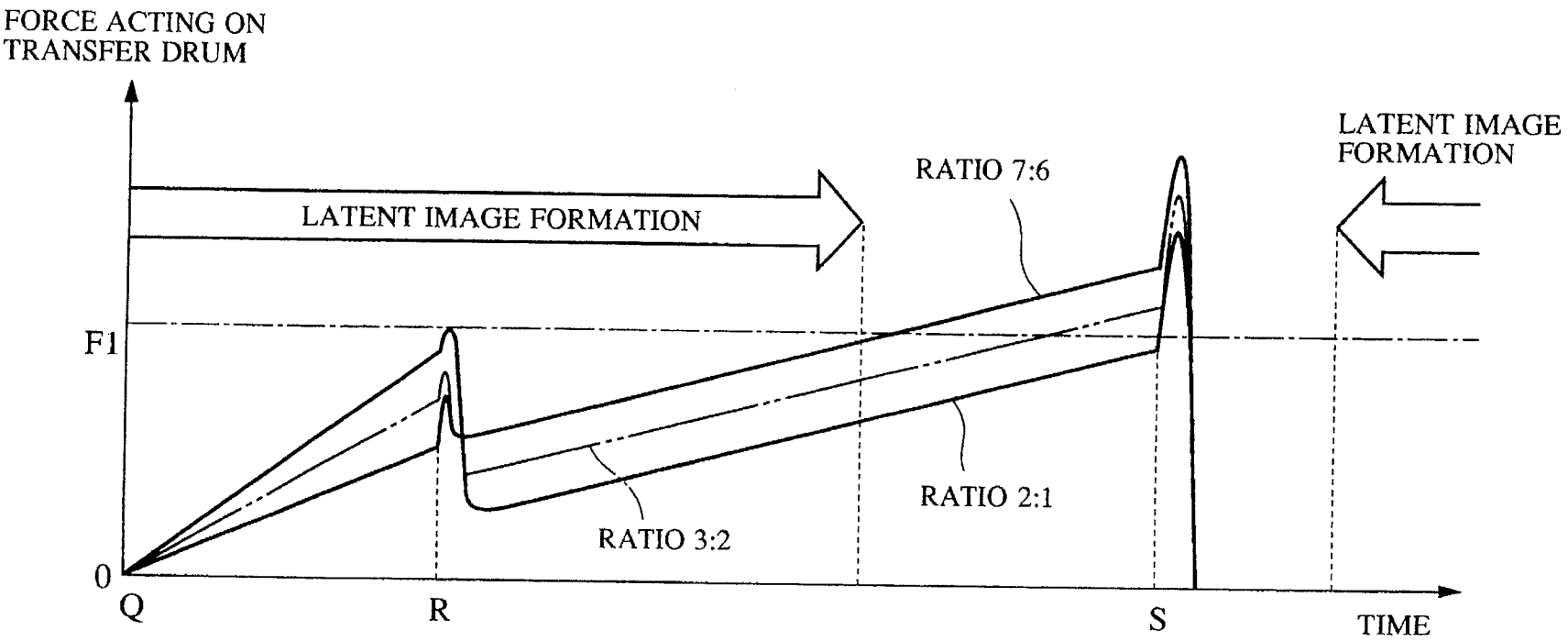
FIG. 9 is a graph showing changes with time of the force of the recording sheet acting on the transfer drum when the register roller position is changed.

The forces acting on the transfer drum 5 before and after register release are well balanced thereby, as shown in FIG. 9. As a result, the force can be reduced at least through the entire period during latent image formation.

However, the ratio of these path lengths is not limited to 3:2. For example, in this apparatus, the path length between the register rollers 44 and the attraction position is changed between 74 mm and 54 mm, or the path length between the pre-register conveyance rollers 47 and the register rollers 4 is changed between 86 mm and 106 mm. That is, an experiment was made by disposing the register rollers 44 at two positions of 64±10 mm to obtain the following result.

As shown in FIG. 9, in either case, F1 is not exceeded at least during latent image formation, and there is therefore no influence upon the image formation. These two positions correspond to path length ratios of 7:6 and 2:1. The value of the path length between the pre-register conveyance rollers 47 and the register rollers 44 ranging from 86 to 106 mm was determined by setting the path length between the pre-register conveyance rollers 47 and the attraction position to 160 mm. However, this setting was selected by considering the reduction in the overall size of the apparatus. If it is not necessary to limit the apparatus size, the probability of occurrence of deterioration in image quality or the like is rather reduced if the path length is longer. Consequently, the above value may be set to 86 mm or longer.

Embodiment 2

Figure 10:
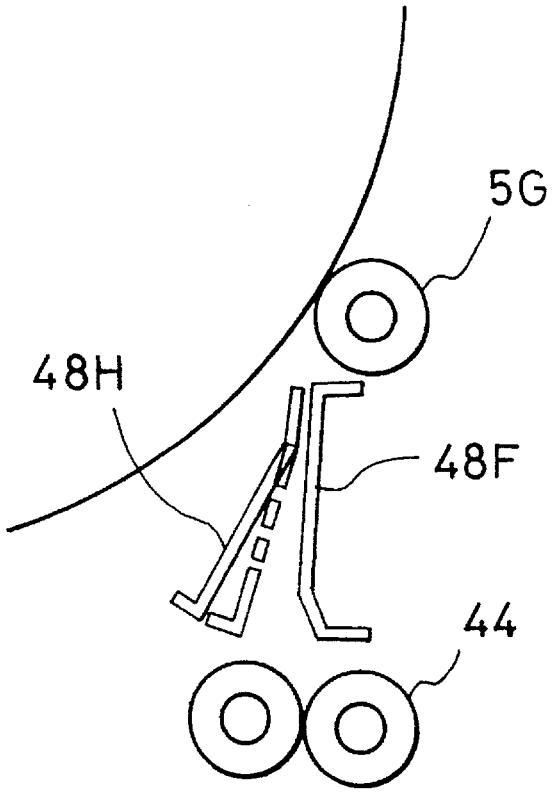
FIG. 10 is a diagram of a second embodiment of the present invention showing an essential feature of this embodiment.

The first embodiment has been described by assuming the condition for eliminating the influence upon image formation of a shock caused at the time of register release is satisfied. However, it is possible that a shocked non-uniformity occurs in the resulting image depending upon the construction of the image forming apparatus to which the present invention is applied. The second embodiment of the present invention, which is intended to avoid such a problem, will be described with reference to FIGS. 10 to 12.

This embodiment differs from the first embodiment in that the larger space provided between guides 48H and 48F for guiding the recording paper sheet to the attraction roller 5G is larger than that in the first embodiment. For ease of understanding, the guide of the first embodiment is indicated by the double-dot-dash line. In this arrangement, the shape of the post-register loop formed is moderated so that the rate at the force acting the transfer drum 5 is increased is reduced in comparison with the first embodiment.

Figure 12:
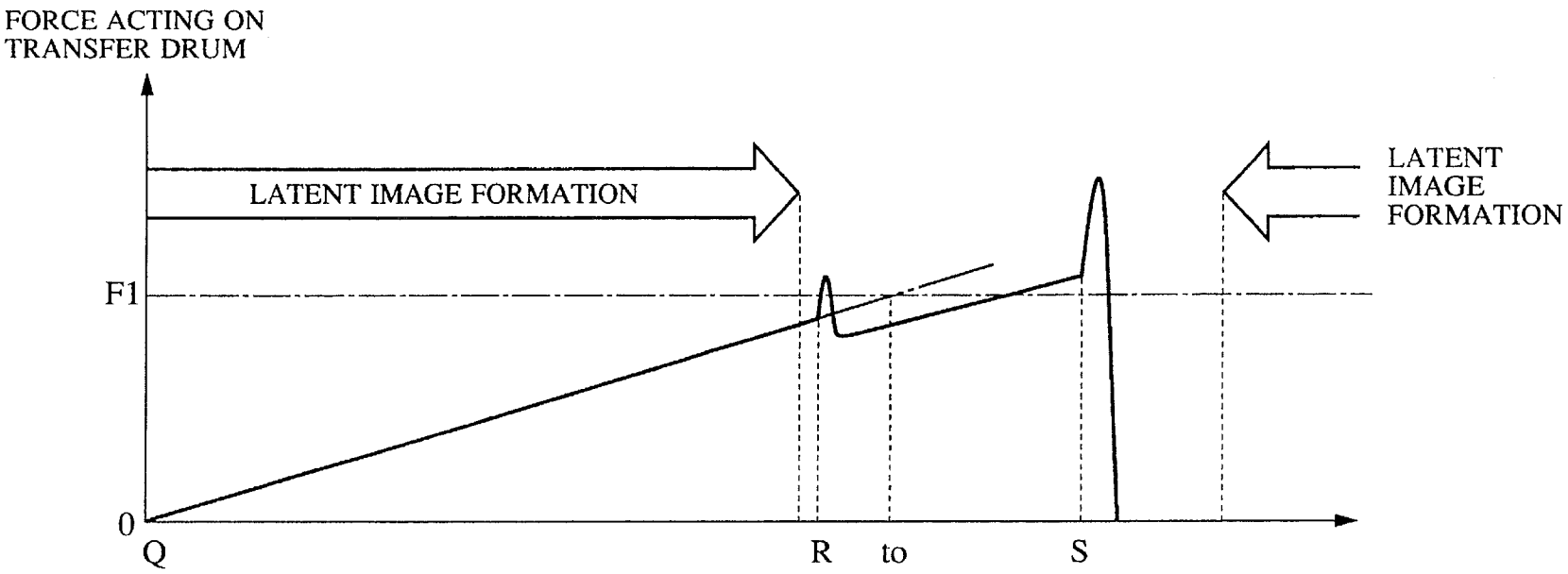
FIG. 12 is a graph showing changes with time of the force of the recording sheet acting on the transfer drum in the image forming process of the second embodiment.

More specifically, referring to FIG. 12, the time $t_0$ at which the force F1 acting on the transfer drum is reached is set after the completion of latent image formation.

Figure 11:
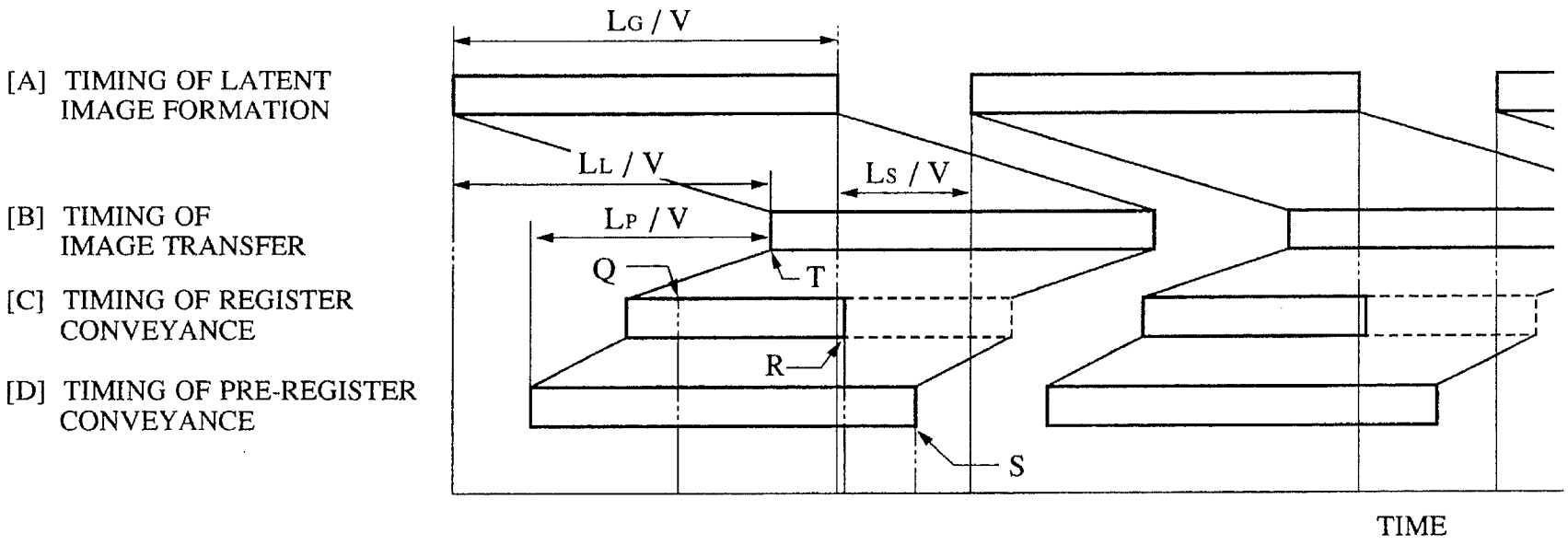
FIG. 11 is a timing chart of an image forming process of the second embodiment.

Further, in this embodiment, the time at which register release is effected (point R) is changed to a time after the completion of latent image formation, as shown in FIGS. 11 and 12, thereby eliminating the possibility of application of a force equal to or larger than F1 to the transfer drum at least during latent image formation. As a result, there is no influence upon the image formation even if the shock at the time of register release is large, and it is therefore possible to obtain a good image free from shocked non-uniformity.

With respect to the manner of increasing the space formed by the guides 48F and 48H, it is desirable to limit the increase in the gap on the attraction roller 5 side. If the distance between the guides 48F and 48H on the attraction roller 5 side is excessively increased, the recording paper sheet flutters when it enters the attraction section, thereby increasing the probability of a reduction in attraction position accuracy.

Since the time $t_0$ at which the force F1 acting on the transfer drum 5 is reached is after the completion of latent image formation as mentioned above, there is substantially no problem even if the paper conveyance is performed without register release. However, as can be understood from the broken line in [C] of FIG. 11, the next latent image formation is usually started at the moment when the trailing end of the recording paper sheet passes the register rollers 44. Conversely, if the apparatus is arranged so that the period for the operation of each of the pair of pre-register conveyance rollers 47 and the pair of register rollers 44 is set completely out of the period for latent image formation, the paper path length must be elongated, resulting in a deterioration in specified performance or characteristics of the apparatus. If the shock at such a moment is considerably large, register release is still necessary.

Embodiment 3

Figure 13:
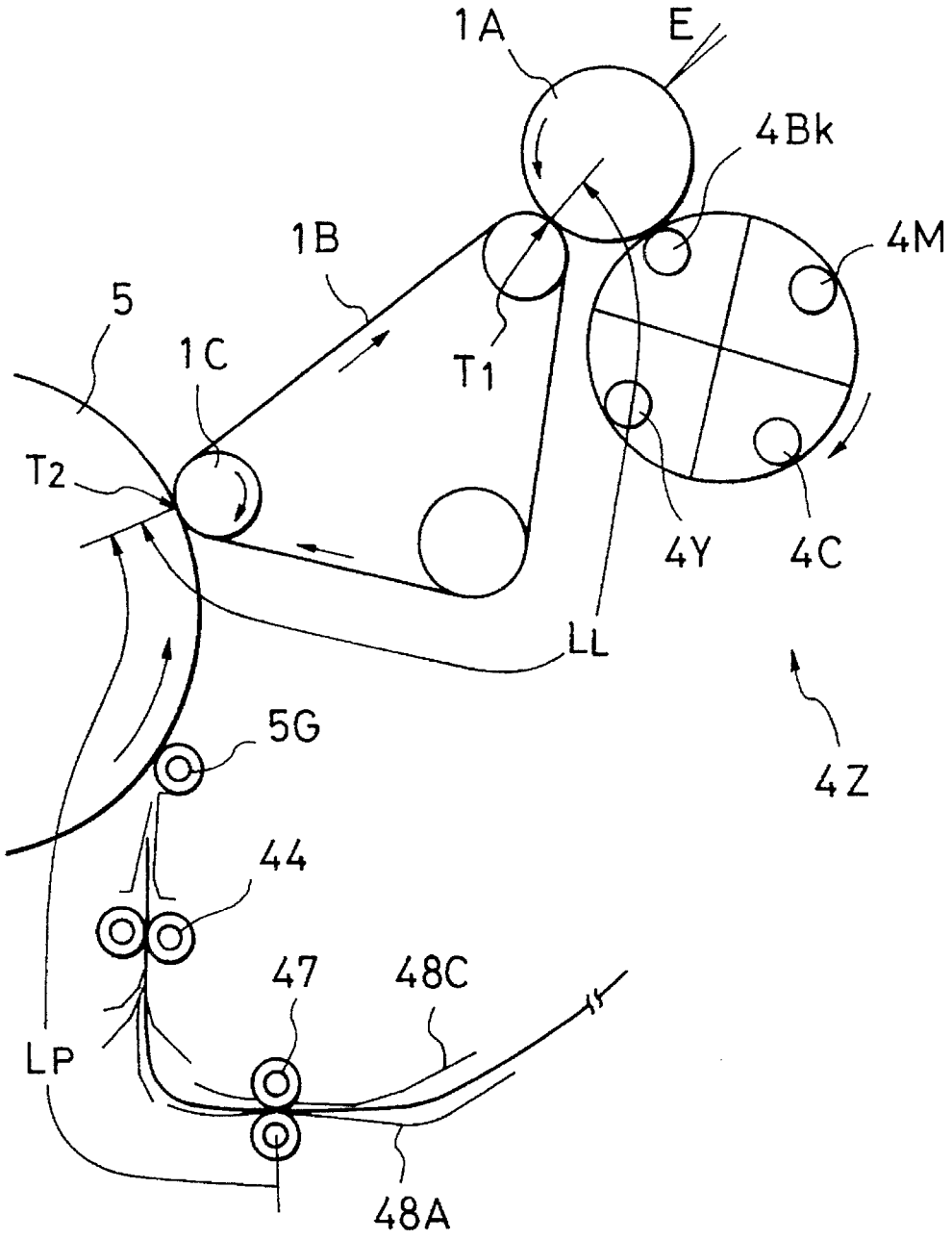
FIG. 13 is a cross-sectional view of a third embodiment of a multicolor image forming apparatus in accordance with a third embodiment of the present invention.
Figure 14:
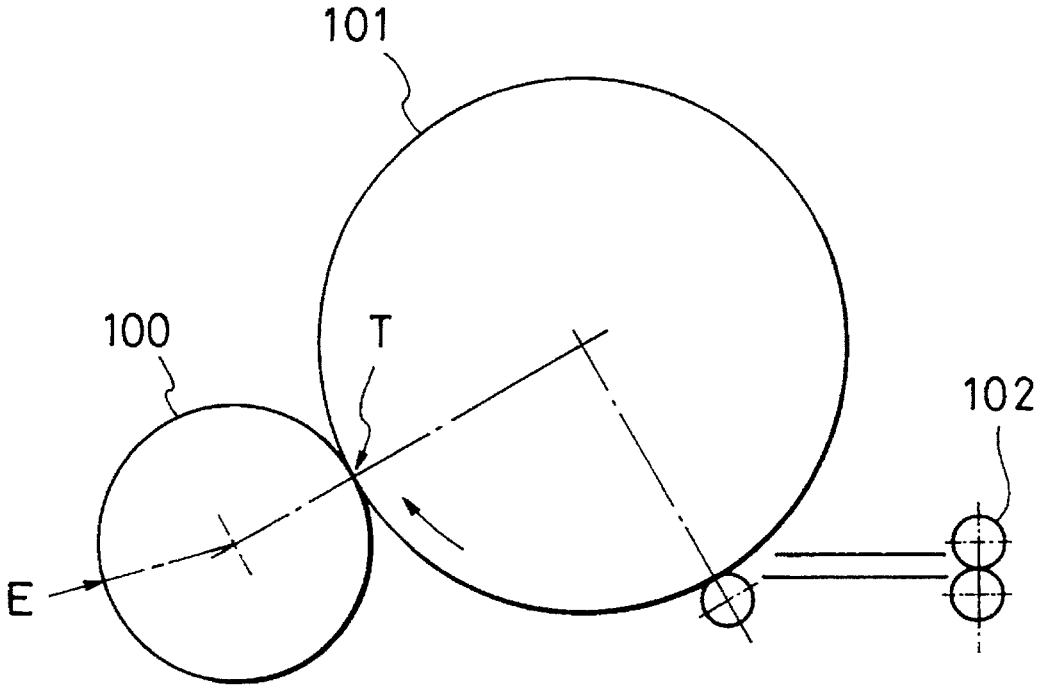
FIG. 14 is a diagram of a conventional image forming apparatus.

An example of an application of the present invention to an image forming apparatus having a rotary development unit and an intermediate transfer belt will next be described with reference to FIG. 13. This embodiment will be described only with respect to points of difference from the first and second embodiments.

The surface of a photosensitive drum 1A is exposed at E to form a latent image. The latent image is developed first with respect to a first color image with a toner of, for example, a development device 4Y in a rotary development unit 4Z having development devices 4Y, 4C, 4M, and 4Bk. This image is transferred to a surface of an intermediate transfer belt 1B wrapped around a plurality of rollers at a first transfer position $T_1$ opposed to the belt 1B. This image again arrives at $T_1$ by revolving while being retained on the intermediate transfer belt 1B. During this revolution, the development device is changed and a second color image is formed on the photosensitive drum 1A by, for example, the development device 4C. This image is transferred by being superposed on the first color image on the surface of the intermediate transfer belt 1B. Subsequently, the same operation is repeated with respect to the development devices 4M and 4Bk to superpose third and fourth color images.

On the other hand, a recording paper sheet is fed in accordance with the time at which the four superposed color images arrive at a second transfer position $T_2$. The recording sheet is conveyed to the position $T_2$ while being supported on the transfer drum 5. At the position $T_2$, the four color images are simultaneously transferred onto the recording sheet. The recording sheet is thereafter separated from the transfer drum 5 to be sent to a fixation unit. The intermediate transfer belt 1B is driven by a driving roller 1C, and a driving torque is transmitted from the driving roller 1C to the transfer drum 5 through a gear (not shown).

In this embodiment, if the path length between the first and second transfer positions on the intermediate transfer belt 1B is $L_L$, the length of recording sheet path from the pre-register conveyance rollers 47 to the second transfer position $T_2$ is $L_P$, and the recording sheet interval in this apparatus is $L_S$, then the components are disposed so that $L_L > L_P > (L_L - L_S)$.

In this arrangement, the recording sheet passes the pre-register conveyance rollers 47 during the period time for transfer of the next first color image as well as during the period of time when the fourth color image is previously transferred from the photosensitive drum 1A onto the intermediate transfer belt 1B at the first transfer position $T_1$. Therefore, even if a shock caused by the passage of the recording sheet is transmitted from the transfer drum 5 to the intermediate transfer belt 1B, it does not affect the image at $T_1$.

This arrangement of this embodiment is also advantageous in that the actual recording sheet path length can be reduced since there is no need to rotate the recording sheet a number of times while attracting the sheet to the transfer drum 5, and that it is therefore possible to reduce the probability of occurrence of sheet conveyance failure, and bending and contamination of the recording sheet.

The effect of this embodiment is not lost even in the case of an image forming process described below. A transfer system may be adopted in which each color image on the intermediate transfer belt is separately transferred onto the recording sheet on the transfer drum, that is, the recording sheet is fed in correspondence with the first color image, the first color image is transferred at the second transfer position T2, the recording sheet revolves a number of times while being supported on the transfer drum 5, and the next color image is superposed each time the recording sheet makes one revolution. Also in this system, there is no possibility of the recording sheet passing the pre-register conveyance rollers 47 during image transfer at the first transfer position T1, thus ensuring formation of a good image.

In this case, there is substantially no influence upon the latent image formation on the photosensitive drum 1A as long as the energy of a shock is not so large, since the force of the recording sheet is transmitted through two units, i.e., the transfer drum 5 and the intermediate transfer belt 1B. In this embodiment, therefore, there is no problem even if the recording sheet passage time is within the period for latent image formation on the photosensitive drum 1A.

The present invention has been described with respect to an arrangement using a laser as a light source for the exposure unit. However, the present invention is also effective when applied to arrangements using any other light sources, e.g., a halogen lamp and a light emitting diode. In the above-described embodiments, the recording sheet is retained on the transfer drum by electrostatic attraction, but this attraction means is not exclusively used for the present invention. For example, a mechanical retaining means such as a clipper may be used. Also, the intermediate transfer member is not limited to a belt and may by be a drum-like member. The means for forming an image on the intermediate transfer member is not limited to electrophotographic means, and any other image forming means, e.g., a thermal transfer system, may be used as long as the recording apparatus is arranged so as to require a recording sheet conveyance mechanism.

What is claimed is:

1. An image forming apparatus comprising:

a photosensitive member for carrying an image;

exposure means for exposing said photosensitive member to form a latent image on the same;

development means for developing the latent image on the photosensitive member to form a toner image;

a transfer member carrier for supporting and conveying a transfer member to a transfer position on said photosensitive member, the toner image on said phtosensitive member being transferred at said transfer position onto the transfer member supported on said transfer member carrier;

first conveyance means for conveying the transfer member to said transfer member carrier;

cancellation means for cancelling a transfer member conveying force of said first conveyance means after a leading end of the transfer member conveyed by said first conveyance means has been supported on said transfer member carrier; and second conveyance means having a nip for conveying the transfer member and capable of conveying the transfer member to said first conveyance means, a trailing end of the transfer member passing through the nip of said second conveyance means during a period of time when the transfer member conveying force of said first conveyance means is canceled by said cancellation means and when said exposure means is not operating.

2. An apparatus according to claim 1, wherein the trailing end of the transfer member having the leading end supported on said transfer member carrier passes through the nip of said second conveyance means after the latent image formation on said photosensitive member is completed by said exposure means.

3. An apparatus according to claim 2, wherein if said exposure means forms a first latent image and a second latent image successively on said photosensitive member, the trailing end of the transfer member having the leading end supported on said transfer member carrier passes through the nip of said second conveyance means at a time after the completion of formation of said first latent image and before the start of formation of said second latent image.

4. An apparatus according to claim 2, wherein if the distance from the nip of said second conveyance means to said transfer position along the transfer member conveyance direction is $L_P$ and the distance from an exposure position at which said exposure means exposes said photosensitive member to said transfer position along the direction of movement of said photosensitive member is $L_L$, then $L_L > L_P$ is satisfied.

5. An apparatus according to claim 4, wherein if said exposure means forms a first latent image and a second latent image successively on said photosensitive member, the trailing end of the transfer member having the leading end supported on said transfer member carrier passes through the nip of said second conveyance means at a time after the completion of formation of said first latent image and before the start of formation of said second latent image.

6. An apparatus according to claim 5, wherein if said exposure means forms a first latent image and a second latent image successively on said photosensitive member, and if the distance through which said photosensitive member moves after the completion of formation of said first latent image and before the start of formation of said second latent image is $L_S$, then $L_P > L_L - L_S$ is satisfied.

7. An apparatus according to claim 3 or 5, wherein said first latent image and said second latent image are successively developed by said development means and are transferred onto the transfer member supported on said transfer member carrier by being superposed one on another.

8. An apparatus according to claim 3 or 5, wherein a first transfer member and a second transfer member are successively conveyed onto said transfer member carrier, and a first toner image corresponding to said first latent image is transferred to said first transfer member while a second toner image corresponding to said second latent image is transferred to said second transfer member.

9. An apparatus according to claim 1, further comprising drive transmission means for transmission of a driving force between said photosensitive member and said transfer member carrier.

10. An apparatus according to claim 1, wherein the speed at which the transfer member is conveyed by said first conveyance means is higher than the speed at which said transfer member carrier moves.

11. An apparatus according to claim 1 or 10, wherein the speed at which the transfer member is conveyed by said second conveyance means is higher than the speed at which said transfer member carrier moves.

12. An apparatus according to claim 1, wherein said first conveyance means has a pair of rotating members opposed to each other, and conveys the transfer member by pinching the same by a nip between said pair of rotating members.

13. An apparatus according to claim 1 or 12, wherein said second conveyance means has a pair of rotating members opposed to each other, and conveys the transfer member by pinching the same by a nip between said pair of rotating members.

14. An apparatus according to claim 12, wherein said cancellation means cancels the transfer member conveying force of said first conveyance means by separating said pair of rotating members.

15. An apparatus according to claim 1, further comprising attraction means for electrostatically attracting the transfer member to said transfer member carrier, said first conveyance means conveying the transfer member to said attraction means.

16. An apparatus according to claim 1, wherein after the leading end of the transfer member has arrived at said first conveyance means previously stopped, said second conveyance means forms a loop in the transfer member, thereafter stops conveyance temporarily, and restarts driving a predetermined time period after a time when said first conveyance means starts driving.

17. An apparatus according to claim 1, wherein said first conveyance means is disposed in a transfer member conveyance path from the position of said transfer member carrier to the nip of said second conveyance means through which the transfer member is conveyed by said first conveyance means, said first conveyance means being disposed between a center of said transfer member conveyance path and said transfer member carrier.

18. An apparatus according to claim 1, wherein said cancellation means starts cancelling the transfer member conveying force of said first conveyance means during the time period when said exposure means is not operating.

19. An image forming apparatus comprising:

an image carrier capable of carrying an image;

an image forming means for forming an image on said image carrier;

a transfer member carrier for supporting and conveying a transfer member to a transfer position on said image carrier, the image on said image carrier being transferred at said transfer position onto the transfer member supported on said transfer member carrier;

first conveyance means for conveying the transfer member to said transfer member carrier;

cancellation means for cancelling a transfer member conveying force of said first conveyance means after a leading end of the transfer member conveyed by said first conveyance means has been supported on said transfer member carrier; and second conveyance means having a nip for conveying the transfer member and capable of conveying the transfer member to said first conveyance means, a trailing end of the transfer member passing through the nip of said second conveyance means during a period of time when the transfer member conveying force of said first conveyance means is canceled by said cancellation means and when said image forming means is not operating.

20. An apparatus according to claim 19, wherein the trailing end of the transfer member having the leading end supported on said transfer member carrier passes through the nip of said second conveyance means after the image formation on said image carrier is completed by said image forming means.

21. An apparatus according to claim 20, wherein if said image forming means forms a first image and a second image successively on said image carrier, the trailing end of the transfer member having the leading end supported on said transfer member carrier passes through the nip of said second conveyance means at a time after the completion of formation of said first image and before the start of formation of said second image.

22. An apparatus according to claim 20, wherein if the distance from the nip of said second conveyance means to said transfer position along the transfer member conveyance direction is $L_P$ and the distance from an image forming position at which said image forming means forms the image on said image carrier to said transfer position along the direction of movement of said image carrier is $L_L$, then $L_L > L_P$ is satisfied.

23. An apparatus according to claim 22, wherein if said image forming means forms a first image and a second image successively on said image carrier, the trailing end of the transfer member having the leading end supported on said transfer member carrier passes through the nip of said second conveyance means at a time after the completion of formation of said first image and before the start of formation of said second image.

24. An apparatus according to claim 23, wherein if said image forming means forms a first image and a second image successively on said image carrier, and if the distance through which said image carrier moves after the completion of formation of said first image and before the start of formation of said second image is $L_S$, then $L_P > L_L - L_S$ is satisfied.

25. An apparatus according to claim 19, wherein said image forming means has a photosensitive member on which a toner image is formed, the toner image on said photosensitive member being transferred onto said image carrier.

26. An apparatus according to claim 26, wherein said image forming means transfers toner images successively formed on said photosensitive member onto said image carrier by superposing the toner images one on another, the toner images transferred onto said image carrier being collectively transferred onto the transfer member supported on said transfer member carrier at said transfer position.

* * * * *

UNITED STATES PATENT AND TRADEMARK OFFICE

CERTIFICATE OF CORRECTION

PATENT NO. : 5,602,636
DATED : February 11, 1997
INVENTOR(S) : Kunihiko MATSUZAWA It is certified that error appears in the above-indentified patent and that said Letters Patent is hereby corrected as shown below:

COLUMN 6:

Line 34, delete "are".

COLUMN 10:

Line 13, after "it", insert --is-- and after "Q)", insert a comma (",");
Line 14, delete the comma (",");
Line 15, after "[C]", insert a period (".").

COLUMN 14:

Line 47, delete "by".

Signed and Sealed this

First Day of July, 1997

Bruce Lehman

*Attest:*

BRUCE LEHMAN

*Attesting Officer*

*Commissioner of Patents and Trademarks*